US005984642A

United States Patent [19]

Danielsson

[11] Patent Number: 5,984,642

[45] **Date of Patent: *Nov. 16, 1999**

[54] PRESSURE INTENSIFIER

[75] Inventor: Dag Danielsson, Västerås, Sweden

[73] Assignee: Flow Holdings GmbH (SAGL) Limited Liability Co., Lugano, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,474

[22] PCT Filed: Jun. 1, 1995

[86] PCT No.: PCT/SE95/00625

§ 371 Date: Nov. 18, 1996

§ 102(e) Date: Nov. 18, 1996

[87] PCT Pub. No.: WO95/33928

PCT Pub. Date: Dec. 14, 1995

[30] Foreign Application Priority Data

Jun. 6, 1994 [SE] Sweden ..... 9401938

[51] Int. Cl.[6] ..... F04B 5/00

[52] U.S. Cl. ..... 417/264; 417/397

[58] Field of Search ..... 417/254, 294, 417/392, 397, 398, 399, 401

[56] References Cited

U.S. PATENT DOCUMENTS

| | | | |
|---|---|---|---|
| 1,568,447 | 1/1926 | Forsyth | 417/264 |
| 1,616,774 | 2/1927 | Warren | 417/264 |
| 2,173,413 | 9/1939 | Foster | 417/264 |
| 5,094,081 | 3/1992 | Osborne . | |

FOREIGN PATENT DOCUMENTS

| | | | |
|---|---|---|---|
| 415355 | 6/1922 | Germany | 417/264 |
| 30 27 878 | 2/1982 | Germany . | |
| 30 33 739 | 4/1982 | Germany . | |

*Primary Examiner*—Charles G. Freay
*Attorney, Agent, or Firm*—Seed and Berry LLP

[57] ABSTRACT

A pressure intensifier for pressurization of a medium is provided, comprising a low-pressure cylinder (1), in which a low-pressure piston (2) is axially displaceable, and two high-pressure chambers (3, 4) which are each arranged coaxially with and on separate sides of the low-pressure cylinder (1) and which each exhibit an axially displaceable high-pressure piston (9, 10) which are secured to the low-pressure piston (2). A channel (16), provided with a nonreturn valve (17), connects the two high-pressure chambers. The area of one high-pressure piston (9) may be larger than the area of the other high-pressure piston (10).

22 Claims, 1 Drawing Sheet

PRESSURE INTENSIFIER

TECHNICAL FIELD

The present invention relates to a pressure intensifier for pressurization of a medium, comprising a low-pressure cylinder, in which a low-pressure piston is axially displaceable, a first and a second high-pressure chamber for receiving the medium, in which high-pressure chambers a first and a second high-pressure piston, respectively, are axially displaceable, and at least one inlet and one outlet for the medium, wherein the first and second high-pressure chambers are arranged coaxially with the low-pressure cylinder and on one side each thereof, and wherein the first and second high-pressure pistons are secured to the low-pressure piston.

The pressure intensifier according to the invention is especially suitable to use when the pressurized medium is utilized to generate a high pressure in an external pressure device, for example a press, which is arranged outside the pressure intensifier and for high-pressure treatment of liquid substances.

BACKGROUND ART

Pressure intensifiers have long been used to pressurize media to very high pressures. Usually, the pressure intensifier comprises a low-pressure chamber and one or more high-pressure chambers. In the low-pressure chamber a low-pressure piston is displaceably arranged. This low-pressure piston is secured to a high-pressure piston in the respective high-pressure chamber. The low-pressure piston has an area which is larger than the area of the high-pressure pistons.

Upon pressurization of a medium, the medium is supplied through an inlet to the high-pressure chamber. The inlet is closed, whereupon a certain relatively low pressure is supplied to the low-pressure chamber. This usually occurs hydraulically. When the supplied pressure acts on the low-pressure piston, the piston is displaced, causing the high-pressure piston to be displaced inwards in the high-pressure chamber. Since the high-pressure piston has a smaller area than the low-pressure piston, the displacement will result in a certain higher pressure of the medium in the high-pressure chamber. The pressurized medium can thereafter, via an outlet arranged in the high-pressure chamber and via high-pressure conduits, be passed on to an external pressure device, for example a press. With this type of pressure intensifier, pressures up to around 15000 bar may be attained.

One known type of pressure intensifier comprises two high-pressure chambers. These high-pressure chambers are arranged coaxially with the low-pressure chamber, one on each side thereof. Each high-pressure chamber is limited at its outer ends by an end member and exhibits an axially displaceable high-pressure piston which is secured to the low-pressure piston in the low-pressure chamber. When the low pressure is supplied to the low-pressure chamber on one side of the low-pressure piston, the low-pressure piston is displaced in the opposite direction. This leads to generation of the high pressure in that high-pressure chamber which is arranged on that side of the low-pressure piston which is opposite to that where the low pressure is supplied.

By alternately supplying the low pressure to each side of the low-pressure piston, this type of pressure intensifier may be caused to operate as a double-acting pump. When the pistons are in one of their end positions, the first high-pressure chamber is empty and the second high-pressure chamber is filled with non-pressurized medium. When, thereafter, the pistons are displaced towards the other end position, the first high-pressure chamber is filled with non-pressurized medium via its inlet. At the same time, during the first part of the displacement, the medium in the second high-pressure chamber is pressurized. During the remaining displacement, when the high pressure has been achieved, the pressurized medium is pressed out of the second high-pressure chamber and via its outlet and a high-pressure conduit to the external pressure device where the same high pressure prevails. When the pistons are moved back to their first end position, the second high-pressure chamber is filled with non-pressurized medium while at the same time the medium in the first high-pressure chamber is pressurized and is pressed out into the external unit.

PROBLEMS

In order for the pressure intensifier described above to function, two high-pressure connections and two low-pressure connections are required. Both the first and the second high-pressure chamber must be provided with an inlet and an outlet. Alternatively, each high-pressure chamber may have a combined inlet and outlet which is connected to a high-pressure conduit. This high-pressure conduit must then be provided with a branch for connection of a low-pressure conduit for supply of a non-pressurized medium and a high-pressure conduit for conveying the pressurized medium to the external pressure unit. These inlets and outlets and branches and connections, respectively, entail problems in the manufacture and operation of the pressure intensifier.

If each high-pressure chamber is provided with an inlet and an outlet, this means that two openings with channels must be arranged in that end member of each high-pressure chamber which is subjected to pressure. Each such opening and channel constitutes a weakening which, at the very high and pulsating pressures which prevail, easily gives rise to fatigue damage in the material. This, in turn, means that the parts which are subjected to pressure must be considerably oversized to achieve the necessary safety margins. Alternatively, the parts have to be replaced after a smaller number of pressure cycles than what would be necessary if only one opening and channel were arranged in the end member of each high-pressure chamber.

In those cases where the high-pressure chamber is provided with a combined inlet and outlet which branches off into a low-pressure and a high-pressure conduit, cross-bores must be provided in the parts subjected to pressure, namely at the branch point. Also such cross-bores constitute weakened points which cause fatigue problems at the very high and pulsating pressures prevailing.

The embodiment of a pressure intensifier described above further means that at least one of the two high-pressure conduits cannot be straight but must be designed with angles or bends. The reason for this is that the outlets of the two high-pressure chambers are directed in immediately opposite directions and the high-pressure conduits which have been connected to the outlets are to lead to a common external high-pressure device. Such angles and bends of conduits are very difficult from the point of view of high pressure since they entail cross-bores or other weakened points which are sensitive to fatigue.

An additional problem with the current technique according to the above is that the pressure intensifier must be provided with four nonreturn valves, one for each supply and discharge conduit, respectively. Nonreturn valves for conduits where the pressure may amount to about 15000 bar are costly and sensitive and they easily give rise to operational disturbances. Therefore, it is desirable to reduce the number of nonreturn valves to the greatest possible extent.

The object of the present invention is, therefore, to provide a pressure intensifier which is more reliable and less expensive to manufacture than prior art pressure intensifiers. This is achieved by providing a pressure intensifier which eliminates the need of cross-bores in parts subjected to high pressure, makes possible the use of straight high-pressure conduits, reduces the number of nonreturn valves from four to two and the number of high- and low-pressure connections, respectively, from two to one, and in which the tubing may be reduced.

THE SOLUTION

The above object is achieved by a pressure intensifier of the kind described in the introductory part of the description and which is characterized by a channel extending through the low-pressure piston and the first and second high-pressure pistons for conveying the medium between the first and second high-pressure chambers, and by means which prevent the medium from flowing from the second high-pressure chamber to the first high-pressure chamber.

Since a channel is arranged between the first and the second high-pressure chamber, it is possible to supply the medium in the first high-pressure chamber and to allow the medium to pass, during the pressurization, to the second high-pressure chamber in order to conduct the pressurized medium, when the correct pressure is achieved, via an outlet in the second high-pressure chamber. This means that the first high-pressure chamber need only be provided with a low-pressure inlet and the second high-pressure chamber only with a high-pressure outlet. Further, it is possible to design that high-pressure conduit which extends from the outlet to the external pressure device as a straight conduit.

According to one embodiment of the pressure intensifier according to the invention, the means which prevent the medium from flowing from the second high-pressure chamber to the first high-pressure chamber consist of a nonreturn valve which is arranged in the channel. Compared with the prior art, this design allows the number of nonreturn valves to be reduced to two, one near the inlet and one in the channel.

Further, an embodiment of the pressure intensifier according to the invention means that the area of the first high-pressure piston is larger than the area of the second high-pressure piston. In this way, also the volume of the first high-pressure chamber is larger than the volume of the second high-pressure chamber. This makes it possible to obtain a flow of pressurized medium out of the pressure intensifier when the pistons are displaced in both directions. By selecting different area ratios between the two high-pressure pistons, it is possible to obtain different ratios between the outflowing volume when the piston is displaced in the respective direction.

A special case of the area ratio of the high-pressure pistons is represented by an embodiment of the invention in which the area of the first high-pressure piston is about twice as large as the area of the second high-pressure piston. This causes the flow out of the second high-pressure chamber to be equally great when the pistons are moving in both directions. This embodiment also allows the same low pressure to be supplied to both sides of the low-pressure cylinder for displacement of the pistons in the respective directions. This means that the hydraulic unit which is used to supply the low pressure can be utilized optimally, since it may work with a maximum pressure for displacement of the pistons in both directions.

One embodiment of the invention is characterized in that the inlet is arranged in the first high-pressure chamber, that this inlet is connected to a supply conduit for the medium, that this conduit is provided with means which may be controlled to prevent or allow the medium to pass through the conduit in a direction from the first high-pressure chamber, that the outlet is arranged in the second high-pressure chamber, and that a discharge conduit which is provided with means preventing the medium from flowing in a direction towards the second high-pressure chamber is connected to the outlet.

In a pressure intensifier according to this embodiment it is possible to obtain two different gear ratios of the pressure intensifier. When the controllable means prevent the medium from flowing back from the first high-pressure chamber through the supply conduit, both high-pressure chambers are active and the pressure intensifier delivers a large flow under a relatively low pressure. In this case, the force from the low-pressure cylinder is approximately as great as the force which arises due to the difference in area between the first and the second high-pressure piston. When, thereafter, the controllable means are opened for passage of the medium in a direction from the first high-pressure chamber, only the second high-pressure chamber is active. The pressure intensifier then delivers a smaller flow which may be pressurized up to maximum pressure. Thus, it is possible to use one and the same hydraulic unit for operation of the pressure intensifier in the two cases of gear ratios. The hydraulic unit may be relatively small.

An outflow of pressurized medium, varied as described above, may be desirable, for example for high-pressure treatment of foodstuffs. This embodiment also allows the axial forces acting on the end members of the pressure intensifier to be kept relatively small.

BRIEF DESCRIPTION OF THE DRAWING

Two exemplifying embodiments of the invention will be described below with reference to the accompanying drawing.

Figure 1:
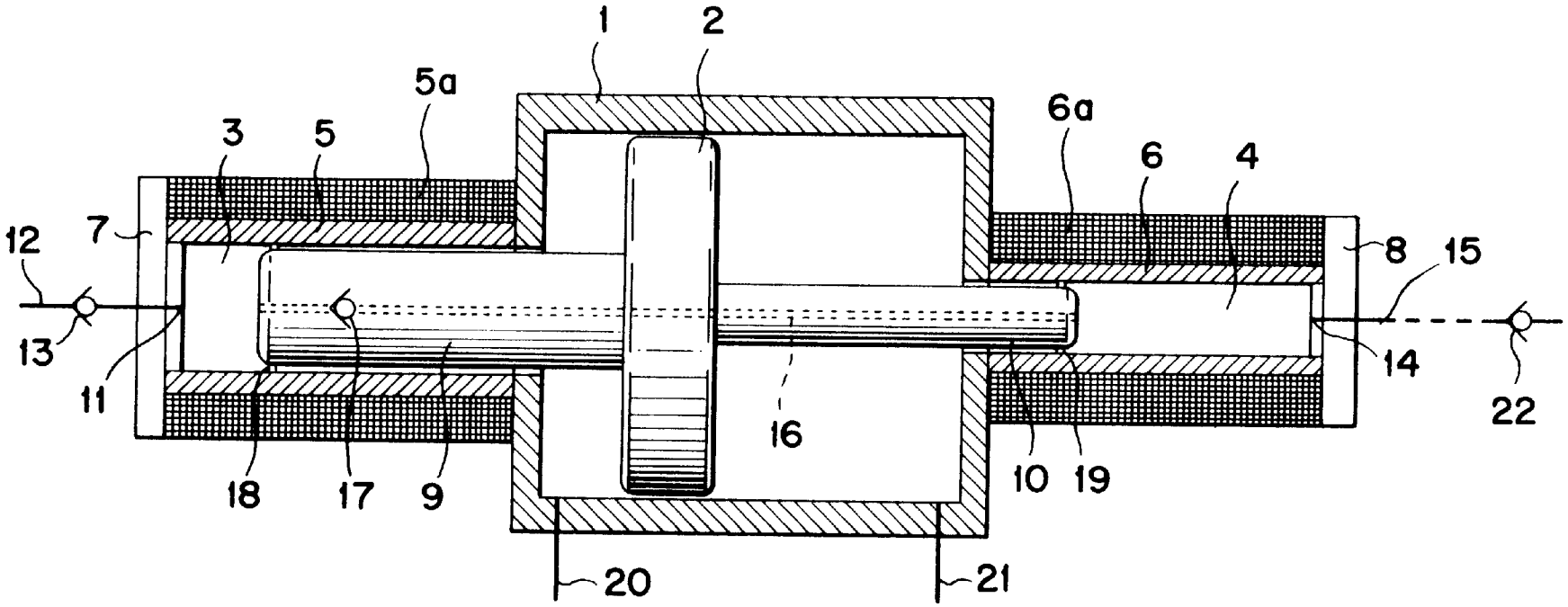
FIG. 1 is a schematic longitudinal section through a pressure intensifier according to the invention.

The pressure intensifier shown in FIG. 1 comprises a low-pressure cylinder 1 in which a low-pressure piston 2 is axially displaceable. The low-pressure cylinder 1 is thus divided into two sides and is filled on both sides with a hydraulic medium. On one side of the low-pressure cylinder 1 and coaxially therewith, a first high-pressure cylinder 5 is arranged. Further, on the opposite side of the low-pressure cylinder, a second high-pressure cylinder 6 is arranged coaxially with the low-pressure cylinder 1. The two high-pressure cylinders 5, 6 are each radially prestressed with a wire winding 5*a* and 6*a*, respectively, in a known manner. Further, an end member 7 and 8, respectively, is arranged at the outer ends of the two high-pressure cylinders 5, 6. These end members 7, 8 are supported outwardly by a joint (not shown) for absorbing the axial forces. A first high-pressure piston 9 which is secured to the low-pressure piston 2 is arranged axially displaceable in the first high-pressure cylinder 5. In a corresponding way, a second high-pressure piston 10 is secured to the low-pressure piston 2 and axially displaceable in the second high-pressure cylinder 6. In this way, the high-pressure cylinders 5, 6, the end members 7, 8 and the high-pressure pistons 9, 10 define a first 3 and a second 4 high-pressure chamber, respectively, for receiving the medium. The areas of the two high-pressure pistons 9, 10 are sized relative to each other such that the area of the first high-pressure piston 9 is twice as large as the area of second 10.

In the end member 7 of the first high-pressure chamber 3, an inlet 11 for the medium is arranged. To this inlet 11 a conduit 12 for supply of the medium is connected. At its other end, the conduit 12 is connected to a low-pressure pump (not shown) which supplies the medium from a storage tank (not shown). Further, a first nonreturn valve 13 is arranged near the inlet 11. This first nonreturn valve 13 allows passage of the medium in a direction towards the pressure intensifier but blocks the medium from flowing from the pressure intensifier. Further, an outlet 14 is arranged in the end member 8 of the second high-pressure chamber 4. This outlet 14 is connected to a high-pressure conduit 15 for conveying the pressurized medium from the pressure intensifier. The high-pressure conduit 15 may, for example, be connected to a press or an external pressure container (not shown).

Through the first and the second high-pressure piston 9, 10 and through the low-pressure piston 2, there extends a channel 16. This channel 16 connects the first high-pressure chamber 3 to the second high-pressure chamber 4 and allows the medium to flow from the first 3 to the second 4 high-pressure chamber. A second nonreturn valve 17 is arranged in the channel 16 and blocks the medium from flowing from the second high-pressure chamber 4 to the first high-pressure chamber 3.

The two high-pressure chambers 3, 4 are sealed by means of high-pressure seals 18, 19 in a known manner. In addition, low-pressure seals (not shown) are arranged in a known manner for sealing the low-pressure cylinder 1.

For operation of the pressure intensifier, the low-pressure cylinder is provided with two hydraulic connections 20, 21 for a hydraulic medium which is supplied by means of a hydraulic unit (not shown).

There will now be described how the pressure intensifier functions during operation. At the beginning of a cycle, the two high-pressure pistons 9, 10 and the low-pressure piston 2 are in their lefthand end position according to the figure. The first high-pressure chamber 3 is empty, whereas the second high-pressure chamber 4 is filled with pressurized medium. The pressure in the second high-pressure chamber 4 may, in the example shown, be around 8000 bar. The low-pressure piston 2 is now caused to be displaced to the right in the figure. This is done by supplying the hydraulic medium to the lefthand side of the low-pressure cylinder 1 through the hydraulic connection 20 while at the same time the corresponding quantity of hydraulic medium is passed from the righthand side of the low-pressure cylinder 1 through the hydraulic connection 21. The pressure of the supplied hydraulic medium may, in the example shown, be around 250 bar.

When the pistons 2, 9, 10 are thus displaced to the right, the pressurized medium in the second high-pressure chamber 4 will be pressed out through an outlet 14 and further via the high-pressure conduit 15 to the external press or the pressure container. The second nonreturn valve 17 prevents the medium from flowing from the second high-pressure chamber 4 to the first high-pressure chamber 3. At the same time, non-pressurized medium is sucked into the first high-pressure chamber 3, via the supply conduit 12, the first nonreturn valve 13 and the inlet 11.

When the pistons 2, 9, 10 are in their righthand end position, the first high-pressure chamber 3 is filled with non-pressurized medium whereas the second high-pressure chamber 4 is empty. The high pressure from the external pressure or the pressure container acts via the high-pressure conduit 15 on the second high-pressure piston 10. In this position, the hydraulic pressure acting on the lefthand side of the low-pressure piston 12 is disconnected. This causes the pistons 2, 9, 10, while being influenced by the high pressure in the external unit, to be displaced somewhat to the left in the figure, until a pressure balance between the first and second high-pressure chambers 3, 4 has been achieved. Thus, the medium in the first high-pressure chamber 3 is pressurized to a pressure corresponding to half the pressure in the second high-pressure chamber 4. The first nonreturn valve 13 thus prevents the medium in the first high-pressure chamber 3 from leaving this chamber via the inlet 11. Thereafter, the right-hand side of the low-pressure cylinder 1 is pressurized to the same pressure as previously the lefthand side, by supplying hydraulic medium via the hydraulic connection 21. At the same time, hydraulic medium is passed from the lefthand side of the low-pressure cylinder through the hydraulic connection 20. The pistons 2, 9, 10 are thus displaced to the left in the figure, whereby the medium present in the first high-pressure chamber 3 is pressurized to full pressure, that is, to the same pressure as that which prevails in the second high-pressure chamber 4. Thereafter, the medium passes through the channel 9, via the nonreturn valve 17, from the first 3 to the second 4 high-pressure chamber. Half of this medium is also pressed further out through the outlet 14 and via the high-pressure conduit 15 to the external unit. The reason for this is that the area of the second high-pressure piston 10 is half a large as the area of the first high-pressure piston 9 and the second high-pressure chamber 4 thus accommodates only half of the volume of the first high-pressure chamber 3.

When the pistons 2, 9, 10 have again reached their lefthand end positions, the cycle is completed and the next cycle may star. The pressure intensifier described above thus operates as a two-stroke pump. In each cycle, a certain quantity of the medium is sucked into the pressure intensifier during one piston stroke. The same quantity of the pressurized medium is pressed out in each cycle, distributed on two piston strokes. In addition to the advantages described above, this embodiment of the pressure intensifier means that the end member 8 of the second high-pressure chamber 4 during the whole cycle is subjected to an essentially constant pressure. In this way, pressure pulses which easily result in fatigue damage on the material are avoided.

An alternative embodiment of the pressure intensifier according to the invention will be described below. Also in this case, reference is made to FIG. 1. Elements 9 and 13 here have a design somewhat different from that in the embodiment described above. The differences will be explained in the following text.

This embodiment comprises, in addition to the above-mentioned parts, also a third nonreturn valve 22 which is arranged in the outlet conduit 15 and which allows passage of the medium in a direction from the second high-pressure chamber 4, but blocks the medium from flowing back. Further, in this embodiment the area of the first high-pressure piston 9 is five times as large as the area of the second high-pressure piston 10. In addition, the first nonreturn valve 13 is here designed such that it may be opened also for passage in a direction from the first high-pressure chamber 3.

This embodiment of the pressure intensifier according to the invention may be used, for example, if the external pressure unit is both to be filled with a large volume of the medium and then pressurized. The embodiment makes possible the use of a relatively small hydraulic unit for driving the pressure intensifier, first as a pump with a large flow under a lower pressure, and then as a high-pressure generator with a smaller flow under a much higher pressure.

In this embodiment, the pressure intensifier operates as follows. At the start of the process, the external pressure container is empty. To fill it with medium, the pressure intensifier is now driven as a double-acting pump. For each piston stroke to the right in the figure, a certain quantity of the medium, corresponding to the volume of the second high-pressure chamber, is pushed out via the outlet 14 and the outlet conduit 15 to the external pressure container. At the same time, the first high-pressure chamber 3 is filled with a volume of the medium five times as large. For each piston stroke to the left, the whole of this larger volume passes via the channel 16 from the first 3 to the second 4 high-pressure chamber. Four-fifths of the volume is further pushed out via the outlet 14 and the outlet conduit 15 to the external pressure container. As long as the external pressure container is not filled, no back pressure occurs in the outlet conduit 15. Therefore, it is possible to use a relatively small hydraulic unit also for displacement to the left of the first high-pressure cylinder 9 with a large area.

When the external pressure container is filled, a back pressure occurs in the outlet conduit 15. The third nonreturn valve 22 prevents this back pressure from acting on the pressure intensifier. On the other hand, the back pressure will act on the medium which is pressed out of the second high-pressure chamber 4 via the outlet 14, the outlet conduit 15 and the third nonreturn valve 22. As the pressure in the external pressure container is building up, the back pressure, of course, also becomes greater. When the back pressure reaches a certain level, the energy from a small hydraulic unit will not be sufficient for pressing out medium via the outlet 14 and the outlet conduit 15 when displacing the first high-pressure piston 9 to the left. The reason for this is that the counter force which acts on the first high-pressure piston 9 is equal to the back pressure multiplied by the large area of this first high-pressure piston 9.

To complete the pressurization of the external high-pressure container to maximum pressure, the first high-pressure chamber 3 is now disconnected by opening the first nonreturn valve 13 for the passage also in the reverse direction. Upon each piston stroke to the right, the maximally pressurized medium in the second high-pressure chamber 4 is presses out via the outlet 14 and the outlet conduit 15 to the external pressure container. Since the second high-pressure piston 10 is very small in relation to the low-pressure cylinder 2, a relatively low pressure which is generated by a small hydraulic unit is sufficient to overcome the back pressure. During the displacement of the pistons 2, 9, 10, the first high-pressure chamber 3 is filled with medium.

Upon piston strokes to the left, one-fifth of the medium in the first high-pressure chamber 3 passes through the channel 16 to the second high-pressure chamber 4. The remaining four-fifths is pushed back out through the inlet 11, the inlet conduit 12, and past the opened first nonreturn valve 13. When this first controlled nonreturn valve 13 is open in the reverse direction, the pressure intensifier thus serves as a single-stroke pump which can generate a very high pressure. The pressure gear ratio is then only dependent on the ratio of the area of the low-pressure piston 2 to the area of the second high-pressure piston 10.

This embodiment also means that the axial forces acting on the pressure intensifier become relatively low. This is because the high pressure in the axial direction only acts on the small areas of the piston 10 and the end member 8 of the second high-pressure chamber 4.

To ensure that one-fifth of the medium in the first high-pressure chamber 3 really passes through the channel 16 to the second high-pressure chamber 4 when the pistons 2, 9, 10 are displaced to the left, a relief valve (not shown) may be arranged at the inlet 11. This counter-support valve creates a pressure drop which is greater than the pressure drops across the nonreturn valve 17 and the channel 16.

The invention is not, of course, limited by the exemplifying embodiments described above but may be varied within the scope of the following claims.

By choosing different area ratios between the first and second high-pressure pistons, the ratio between the quantities delivered at the two piston strokes may be varied. If the area ratio is chosen, for example, as three to one, one-third of the quantity supplied during one cycle is delivered at the piston stroke in a direction towards the second high-pressure chamber, and two-thirds is delivered at the piston stroke in a direction towards the first high-pressure chamber.

The pressurized medium may, as in the examples above, be a pressure medium which is used to generate a pressure in an external press or the like. The pressure intensifier may, however, be used directly for high-pressure treatment of, for example, foodstuffs. The medium then consists of the substance to be treated. When the substance has left the pressure intensifier, it may then directly, via passage of a counter-pressure valve, be returned to normal pressure. Alternatively, while maintaining the high pressure from the pressure intensifier, it may be passed directly to an external pressure container for achieving a certain holding time.

I claim:

1. A pressure intensifier for pressurization of a medium, comprising:

a single low-pressure cylinder;

a single low-pressure piston, the low-pressure piston being disposed in and axially displaceable in the low-pressure cylinder;

a first high-pressure chamber and a second high-pressure chamber for receiving a medium;

a first high pressure piston and a second high-pressure piston, the first high-pressure piston and the second high-pressure piston being, respectively, disposed in and axially displaceable in the first high-pressure chamber and the second high-pressure chamber;

the first and second high-pressure chambers being arranged coaxially with the low-pressure cylinder and on opposite sides thereof, and the first high-pressure piston and the second high-pressure piston being secured to the low-pressure piston;

a channel extending through the low-pressure piston and the first high-pressure piston and the second high-pressure piston for transport of the medium between the first high-pressure chamber and the second high-pressure chamber;

a single non-return valve disposed in the channel for preventing the medium from flowing from the second high-pressure chamber to the first high-pressure chamber; and an inlet for the medium to the first high-pressure chamber and an outlet for the medium from the second high-pressure chamber, wherein an area of the first high-pressure piston is larger than an area of the second high-pressure piston, and the first high pressure piston has a substantially constant diameter along an entire length thereof extending to the low pressure piston.

2. A pressure intensifier according to claim 1, wherein an area of the first high-pressure piston is about twice as large as an area of the second high-pressure piston.

3. The pressure intensifier as set forth in claim 1, wherein the pressure intensifier is free of cross-bores.

4. The pressure intensifier as set forth in claim 1, further comprising one movement arrangement, the movement arrangement including first and second hydraulic connections to the low pressure chamber, the low pressure chamber being divided into first and second chambers by the low pressure piston, the first and second hydraulic connections being connected to the low pressure chamber such that the first and second hydraulic connections are connected to the first and second chambers, respectively.

5. The pressure intensifier as set forth in claim 1, wherein sizes of the first high-pressure piston, the first high-pressure chamber, the low-pressure piston, the low-pressure chamber, the second high-pressure piston, and the second high-pressure chamber are selected such that a pressure of the medium of about 8000 bar is obtainable in the second high-pressure chamber when a pressure of about 250 bar is supplied to the low-pressure chamber.

6. A pressure intensifier for pressurization of a medium comprising:

a low-pressure cylinder;

a low-pressure piston the low-pressure piston being disposed in and axially displaceable in the low-pressure cylinder;

a first high-pressure chamber and a second high-pressure chamber for receiving a medium;

a first high pressure piston and a second high-pressure piston, the first high-pressure piston and the second high-pressure piston being, respectively, disposed in and axially displaceable in the first high-pressure chamber and the second high-pressure chamber;

the first and second high-pressure chambers being arranged coaxially with the low-pressure cylinder and on opposite sides thereof, and the first high-pressure piston and the second high-pressure piston being secured to the low-pressure piston;

a channel extending through the low-pressure piston and the first high-pressure piston and the second high-pressure piston for transport of the medium between the first high-pressure chamber and the second high-pressure chamber; and a single non-return valve disposed in the channel for preventing the medium from flowing from the second high-pressure chamber to the first high-pressure chamber, wherein an inlet for the medium is provided in the first high-pressure chamber, a supply conduit is connected to the inlet, controllable means for alternately preventing and allowing the medium to pass through the supply conduit to the first high-pressure chamber is provided at the supply conduit, an outlet for the medium is provided in the second high-pressure chamber, a discharge conduit is connected to the outlet, and means for preventing the medium from flowing in a direction towards the second high-pressure chamber is provided at the discharge conduit, and the first high pressure piston has a substantially constant diameter along an entire length thereof extending to the low pressure piston.

7. A pressure intensifier according to claim 6, wherein an area of the first high-pressure piston is larger than an area of the second high-pressure piston.

8. A pressure intensifier according to claim 7, wherein the area of the first high-pressure piston is about twice as large as the area of the second high-pressure piston.

9. A pressure intensifier according to claim 6, wherein an area of the first high-pressure piston is about twice as large as an area of the second high-pressure piston.

10. The pressure intensifier as set forth in claim 6, wherein the pressure intensifier is free of cross-bores.

11. The pressure intensifier as set forth in claim 6, further comprising one movement arrangement, the movement arrangement including first and second hydraulic connections to the low pressure chamber, the low pressure chamber being divided into first and second chambers by the low pressure piston, the first and second hydraulic connections being connected to the low pressure chamber such that the first and second hydraulic connections are connected to the first and second chambers, respectively.

12. The pressure intensifier as set forth in claim 6, wherein sizes of the first high-pressure piston, the first high-pressure chamber, the low-pressure piston, the low-pressure chamber, the second high-pressure piston, and the second high-pressure chamber are selected such that a pressure of the medium of about 8000 bar is obtainable in the second high-pressure chamber when a pressure of about 250 bar is supplied to the low-pressure chamber.

13. A pressure intensifier for pressurization of a medium, comprising:

a single low-pressure cylinder;

a single low-pressure piston, the low-pressure piston being disposed in and axially displaceable in the low-pressure cylinder;

a first high-pressure chamber and a second high-pressure chamber for receiving a liquid medium;

a first high pressure piston and a second high-pressure piston, the first high-pressure piston and the second high-pressure piston being, respectively, disposed in and axially displaceable in the first high-pressure chamber and the second high-pressure chamber;

the first and second high-pressure chambers being arranged coaxially with the low-pressure cylinder and on opposite sides thereof, and the first high-pressure piston and the second high-pressure piston being secured to the low-pressure piston;

a channel extending through the low-pressure piston and the first high-pressure piston and the second high-pressure piston for transport of the medium between the first high-pressure chamber and the second high-pressure chamber;

a single non-return valve disposed in the channel for preventing the medium from flowing from the second high-pressure chamber to the first high-pressure chamber;

an inlet for the medium to the first high-pressure chamber and an outlet for the medium from the second high-pressure chamber; and a system connected to the pressure intensifier such that pressure of the medium at the inlet to the first high-pressure chamber is less than pressure of the medium at the outlet to the second high-pressure chamber, wherein an area of the first high-pressure piston is larger than an area of the second high-pressure piston, and wherein the inlet for medium to the first high-pressure chamber includes a non-return valve such that medium in the first high-pressure chamber is delivered from the first high-pressure chamber, through the channel, past the non-return valve in the channel, to the second high-pressure chamber, and from the outlet in second high-pressure chamber during movement of the first high-pressure piston, the second high-pressure piston, and the low-pressure piston in a first direction toward the first high-pressure chamber, and wherein, upon movement of the first high-pressure piston, the second high-pressure piston, and the low-pressure piston in a second direction toward the second high-pressure chamber, medium in the second high-pressure chamber is delivered from the outlet in the second high-pressure chamber.

14. The pressure intensifier as set forth in claim 13, wherein sizes of the first high-pressure piston, the first high-pressure chamber, the low-pressure piston, the low-pressure chamber, the second high-pressure piston, and the second high-pressure chamber are selected such that pressure of the medium delivered from the outlet in the second high-pressure chamber is substantially the same when the first high-pressure piston, the low-pressure piston, and the second high-pressure piston move in the first and in the second direction.

15. The pressure intensifier as set forth in claim 13, wherein sizes of the first high-pressure piston, the first high-pressure chamber, the low-pressure piston, the low-pressure chamber, the second high-pressure piston, and the second high-pressure chamber are selected such that pressure of the medium delivered from the outlet in the second high-pressure chamber is different when the first high-pressure piston, the low-pressure piston, and the second high-pressure piston move in the first direction than pressure of the medium delivered from the outlet in the second high-pressure chamber when the first high-pressure piston, the low-pressure piston, and the second high-pressure piston move in the second direction.

16. The pressure intensifier as set forth in claim 15, wherein sizes of the first high-pressure piston, the first high-pressure chamber, the low-pressure piston, the low-pressure chamber, the second high-pressure piston, and the second high-pressure chamber are selected such that pressure of the medium delivered from the outlet in the second high-pressure chamber is less when the first high-pressure piston, the low-pressure piston, and the second high-pressure piston move in the first direction than pressure of the medium delivered from the outlet in the second high-pressure chamber when the first high-pressure piston, the low-pressure piston, and the second high-pressure piston move in the second direction.

17. The pressure intensifier as set forth in claim 13, wherein sizes of the first high-pressure piston, the first high-pressure chamber, the low-pressure piston, the low-pressure chamber, the second high-pressure piston, and the second high-pressure chamber are selected such that a pressure of the medium of about 8000 bar is obtainable in the second high-pressure chamber when a pressure of about 250 bar is supplied to the low-pressure chamber.

18. A pressure intensifier for pressurization of a medium comprising:

a low-pressure cylinder;

a low-pressure piston the low-pressure piston being disposed in and axially displaceable in the low-pressure cylinder;

a first high-pressure chamber and a second high-pressure chamber for receiving a liquid medium;

a first high pressure piston and a second high-pressure piston, the first high-pressure piston and the second high-pressure piston being, respectively, disposed in and axially displaceable in the first high-pressure chamber and the second high-pressure chamber;

the first and second high-pressure chambers being arranged coaxially with the low-pressure cylinder and on opposite sides thereof, and the first high-pressure piston and the second high-pressure piston being secured to the low-pressure piston;

a channel extending through the low-pressure piston and the first high-pressure piston and the second high-pressure piston for transport of the medium between the first high-pressure chamber and the second high-pressure chamber;

a single non-return valve disposed in the channel for preventing the medium from flowing from the second high-pressure chamber to the first high-pressure chamber; and a system connected to the pressure intensifier such that pressure of the medium at the inlet to the first high-pressure chamber is less than pressure of the medium at the outlet to the second high-pressure chamber, wherein an inlet for the medium is provided in the first high-pressure chamber, a supply conduit is connected to the inlet, controllable means for alternately preventing and allowing the medium to pass through the supply conduit to the first high-pressure chamber is provided at the supply conduit, an outlet for the medium is provided in the second high-pressure chamber, a discharge conduit is connected to the outlet, and means for preventing the medium from flowing in a direction towards the second high-pressure chamber is provided at the discharge conduit, and wherein the controllable means includes a non-return valve such that medium in the first high-pressure chamber is delivered from the first high-pressure chamber, through the channel, past the non-return valve in the channel, to the second high-pressure chamber, and from the outlet in second high-pressure chamber during movement of the first high-pressure piston, the second high-pressure piston, and the low-pressure piston in a first direction toward the first high-pressure chamber, and wherein, upon movement of the first high-pressure piston, the second high-pressure piston, and the low-pressure piston in a second direction toward the second high-pressure chamber, medium in the second high-pressure chamber is delivered from the outlet in the second high-pressure chamber.

19. The pressure intensifier as set forth in claim 18, wherein sizes of the first high-pressure piston, the first high-pressure chamber, the low-pressure piston, the low-pressure chamber, the second high-pressure piston, and the second high-pressure chamber are selected such that pressure of the medium delivered from the outlet in the second high-pressure chamber is substantially the same when the first high-pressure piston, the low-pressure piston, and the second high-pressure piston move in the first and in the second direction.

20. The pressure intensifier as set forth in claim 18, wherein sizes of the first high-pressure piston, the first high-pressure chamber, the low-pressure piston, the low-pressure chamber, the second high-pressure piston, and the second high-pressure chamber are selected such that pressure of the medium delivered from the outlet in the second high-pressure chamber is different when the first high-pressure piston, the low-pressure piston, and the second high-pressure piston move in the first direction than pressure of the medium delivered from the outlet in the second high-pressure chamber when the first high-pressure piston, the low-pressure piston, and the second high-pressure piston move in the second direction.

21. The pressure intensifier as set forth in claim 20, wherein sizes of the first high-pressure piston, the first high-pressure chamber, the low-pressure piston, the low-pressure chamber, the second high-pressure piston, and the second high-pressure chamber are selected such that pressure of the medium delivered from the outlet in the second high-pressure chamber is less when the first high-pressure piston, the low-pressure piston, and the second high-pressure piston move in the first direction than pressure of the medium delivered from the outlet in the second high-pressure chamber when the first high-pressure piston, the low-pressure piston, and the second high-pressure piston move in the second direction.

22. The pressure intensifier as set forth in claim 18, wherein sizes of the first high-pressure piston, the first high-pressure chamber, the low-pressure piston, the low-pressure chamber, the second high-pressure piston, and the second high-pressure chamber are selected such that a pressure of the medium of about 8000 bar is obtainable in the second high-pressure chamber when a pressure of about 250 bar is supplied to the low-pressure chamber.

* * * * *